US008167274B2

(12) United States Patent
Friese et al.

(10) Patent No.: US 8,167,274 B2
(45) Date of Patent: May 1, 2012

(54) CORNER ASSEMBLY

(75) Inventors: Donald E. Friese, Los Angeles, CA (US); Ray Bowie, Los Angeles, CA (US)

(73) Assignee: C. R. Laurence Company, Inc., Los Angeles, CA (US)

( * ) Notice: Subject to any disclaimer, the term of this patent is extended or adjusted under 35 U.S.C. 154(b) by 367 days.

(21) Appl. No.: 12/101,787

(22) Filed: Apr. 11, 2008

(65) Prior Publication Data

US 2009/0256126 A1 Oct. 15, 2009

(51) Int. Cl.
*E04H 17/00* (2006.01)

(52) U.S. Cl. ..... 256/65.07; 256/65.08

(58) Field of Classification Search ..... 256/19, 256/21, 59, 60, 65.01, 65.02, 65.03, 65.07, 256/65.08; 403/178, 205; 52/653.1, 653.2, 52/655.1; 312/108, 111, 140, 265.1, 265.4
See application file for complete search history.

(56) References Cited

U.S. PATENT DOCUMENTS

| | | | | |
|---|---|---|---|---|
| 3,039,799 | A | 6/1962 | Gerace | |
| 3,304,683 | A | 2/1967 | Ferreira | |
| 3,305,221 | A | 2/1967 | Kling | |
| 3,313,527 | A | 4/1967 | Eriksson | |
| 3,333,823 | A * | 8/1967 | Genauer et al. | 256/65.08 |
| 3,385,567 | A | 5/1968 | Case et al. | |
| 3,398,499 | A | 8/1968 | Moore et al. | |
| 3,491,984 | A * | 1/1970 | Nyberg | 256/21 |
| 3,498,589 | A | 3/1970 | Murdock | |
| 3,502,357 | A | 3/1970 | Wagner | |
| 3,506,243 | A * | 4/1970 | Seiler | 256/59 |
| 3,522,933 | A * | 8/1970 | Braun, III | 256/65.02 |
| 3,787,033 | A | 1/1974 | Snyder et al. | |
| 3,869,109 | A | 3/1975 | Russo | |
| 3,955,800 | A | 5/1976 | Russo | |
| 4,014,520 | A | 3/1977 | Walters | |
| D254,031 | S | 1/1980 | Souza, Jr. | |
| 4,238,117 | A | 12/1980 | Newman | |
| 4,351,469 | A | 9/1982 | Newman | |
| 4,370,790 | A | 2/1983 | Rodaway | |
| 4,586,697 | A * | 5/1986 | Tornya | 256/65.11 |
| 4,706,367 | A | 11/1987 | Garringer | |
| 5,011,323 | A * | 4/1991 | Liuo | 403/172 |
| 5,062,732 | A | 11/1991 | Ballerstein | |
| D332,146 | S | 12/1992 | Schreib | |
| 5,193,786 | A | 3/1993 | Guenther | |
| 5,273,258 | A | 12/1993 | Bedics | |
| 5,370,368 | A | 12/1994 | Terrels et al. | |
| 5,441,241 | A | 8/1995 | McKim | |
| 5,516,225 | A * | 5/1996 | Kvols | 403/170 |
| 5,584,469 | A | 12/1996 | Goodwin | |
| 5,647,681 | A | 7/1997 | Chen | |
| 5,765,812 | A | 6/1998 | Guenther | |

(Continued)

*Primary Examiner* — Michael P Ferguson
(74) *Attorney, Agent, or Firm* — Mitchell P. Brook; McKenna Long & Aldridge LLP

(57) ABSTRACT

A corner assembly and manufacturing method comprising two cap rail components each having a channel and at least one receiver within the channel, the components connected or bonded to form a corner fitting having an angle and having a first end and a second end such that the first cap rail component channel and the second cap rail component channel form an angled channel within the corner fitting. At least one pin is disposed in a portion of the receiver within the first cap rail component channel, and at least one pin is disposed in a portion of the receiver within the second cap rail component channel. The assembly also may include a bracket disposed within the channels of the corner fitting.

14 Claims, 16 Drawing Sheets

U.S. PATENT DOCUMENTS

| | | | | |
|---|---|---|---|---|
| 6,131,886 | A | 10/2000 | Venegas, Jr. | |
| D454,207 | S | 3/2002 | Bussler | |
| 6,533,251 | B1 | 3/2003 | Abbaticchio | |
| 6,557,832 | B2 | 5/2003 | Shreiner | |
| 6,568,658 | B2 | 5/2003 | Strome | |
| 6,874,766 | B2 * | 4/2005 | Curatolo | 256/59 |
| 6,912,818 | B2 | 7/2005 | Sprague | |
| 7,082,734 | B2 * | 8/2006 | Rowan | 52/656.1 |
| 7,302,780 | B2 | 12/2007 | Sprague | |
| 2002/0134976 | A1 | 9/2002 | Swartz | |
| 2003/0178614 | A1 | 9/2003 | Venegas, Jr. | |
| 2004/0211952 | A1 | 10/2004 | Barnes et al. | |
| 2006/0059636 | A1 | 3/2006 | Suggate | |
| 2007/0228352 | A1 | 10/2007 | Higgs | |

* cited by examiner

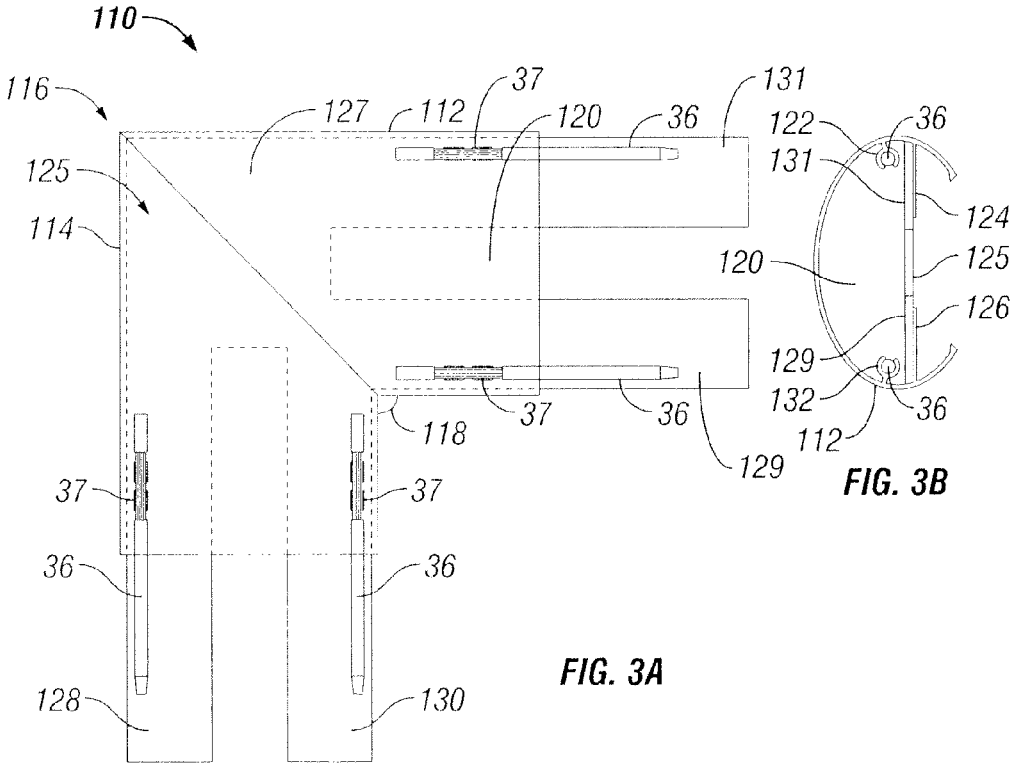
FIG. 3B
FIG. 3A
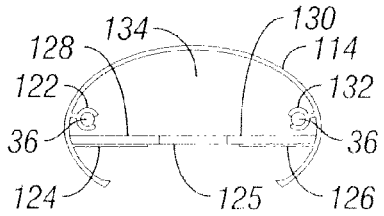
FIG. 3C

CORNER ASSEMBLY

FIELD OF THE INVENTION

The present invention relates to railing systems and components thereof.

BACKGROUND OF THE INVENTION

Railing systems conventionally serve safety functions and also can be used to divide an area into two or more regions. Railings often are used where there is a change in elevation, such as at a landing, or as a guide on stairways and pathways.

Commercially available railing systems suffer from a number of disadvantages, such as labor-intensive installation and requirements for customized components. Customized components are undesirable because of increased time and labor costs required when taking measurements, crafting the components and installing the system. While the straight portions of railing structures generally can be constructed and assembled in a relatively straightforward manner, forming corners often presents more difficult problems.

Some railing systems lack separate corner fittings. In such systems, the corner portion of the railing typically is formed by mitre cutting the edges of the straight railing portions at approximately 45-degree angles. The angled edges of the two straight railing portions are then welded together to form a corner. One disadvantage of this method is the extra time and expense of mitre cutting and welding incurred by the railing installer. In addition, the welded edges may be misaligned and as a result may have exposed sharp edges and/or an unattractive appearance.

Although some corner fittings are commercially available, these components suffer from a number of disadvantages. Even when corner fittings are provided for railing systems, often mitre cutting of the straight railing portions is required to insert the straight portions into the corner component. Furthermore, many corner fittings are of a larger cross-section than the corresponding straight railing portions and as a result have exposed edges which do not align with the straight railing. These exposed edges can be sharp and hazardous to users. In addition, they often are unattractive and visually unappealing. The assembly process, particularly when mitre cutting is required, can be difficult and time consuming for railing installers. Because many corner components lack features to assist in alignment, the assembly process often results in misaligned railway portions. Often, too, commercially available corner fittings lack strengthening components or support structure and therefore are not as resistant to impact as is required in certain settings. Specifically, in many jurisdictions building codes have minimum load requirements for handrails.

Therefore, there exists a need for a pre-fabricated corner fitting for railing systems that eliminates the need for installers to engage in difficult and time consuming mitre cutting of straight railing portions. There also is a need for a corner fitting that is the same cross-section as the straight railing portions, thereby eliminating any dangerous or unattractive exposed edges. There also exists a need for a corner fitting with alignment features and support structure that ensures alignment with straight railing portions and impact resistance. In particular, there exists a need for a corner fitting that provides the support necessary to meet minimum load requirements for handrails.

SUMMARY OF THE INVENTION

The present invention, in its many embodiments, alleviates to a great extent the disadvantages of known railing system corner fittings by providing a corner assembly for a component rail system in which a pre-fabricated welded corner fitting includes alignment features and support structure and can easily be installed in a railway system without the need for mitre cutting. A preferred embodiment of the corner assembly of the present invention includes an angled corner fitting comprising two cap rail components welded together or joined by adhesive bonding to form an angle. The angle may be a right angle, but any angle may be formed depending on the desired configuration of the railing system. The cap rail components may have a generally rectangular, ovular, or tubular shape but other shapes and modifications are possible and will be recognized by those skilled in the art as being within the scope of the present invention. The corner fitting may be coated to provide a smooth, attractive finish and to cover the welded edges of the two cap rail components. The pre-fabricated welded corner fitting design eliminates the need for mitre cutting.

Each cap rail component has a channel, and the channel preferably has two receivers extending from the first end to the second end of the corner fitting. In a preferred embodiment, the receivers within the channels of the corner fitting are substantially circular. Pins are disposed in at least a portion of each receiver at the first and second ends of the corner fitting and extend beyond the end of the corner fitting so they may project into a straight cap rail and facilitate attachment therewith. In particular, the corner fitting is attached to at least one straight cap rail having a channel and preferably two receivers within the channel. The pins disposed in the receivers within the channels of the straight cap rails facilitate connection of the corner assembly to the straight cap rail. The primary purpose of the pins is to align the corner assembly longitudinally to straight cap rail portions of a railing system. Preferably composed of stainless steel, the pins also enhance the strength of the corner assembly. The pin and receiver configuration further provides the advantage of simplifying the railing system installation process by aiding in attachment of the components.

The corner assembly also provides the advantage of improved strength and impact resistance by providing a bracket disposed within the channels of the corner fitting. The bracket has a center portion with a first end and a second end. The bracket preferably has two extensions extending from each end of the center portion. Preferred embodiments include a retainer on each side of the channel into which the bracket fits. The bracket may be disposed between the retainers and the at least one receiver. Some embodiments further include a post mounted bracket, which primarily serves to hold the components of the corner assembly together.

As part of a component railing system, an embodiment of the invention comprises a corner assembly attached to at least one post and at least one straight cap rail having a channel. At least one end of the corner fitting is attached to a straight cap rail. The two bracket extensions extend into the channel of the straight cap rail. In addition, the portions of the pins that extend beyond the ends of the corner fittings are inserted into the receivers within the straight cap rail channel.

A method of manufacturing a corner assembly for a component railing system also is provided. The method comprises at least the following steps: at least two cap rail components are formed, preferably by extrusion, with each component having a first end and a second end, a channel, and two receivers. The cap rail components are welded together to form an angled corner fitting having a first end and a second end. The corner fitting may be coated to provide a smooth, attractive finish and to cover the welded edges of the two cap rail components. At least one pin is pressed within at least a portion of each receiver at the first and second ends of the corner fitting so the pins extend beyond the ends of the corner fitting. A bracket also is inserted within the channels of the corner fitting. A post mounted bracket also may be attached to the corner fitting to hold all of the components of the corner assembly together.

These and other features and advantages of the present invention will be appreciated from review of the following detailed description of the invention.

BRIEF DESCRIPTION OF THE DRAWINGS

The foregoing and other objects of the invention will be apparent upon consideration of the following detailed description, taken in conjunction with the accompanying drawings, in which:

FIGS. 3A-C are plan views of an alternative embodiment of a corner assembly in accordance with the present invention;

DETAILED DESCRIPTION

Figure 1A:
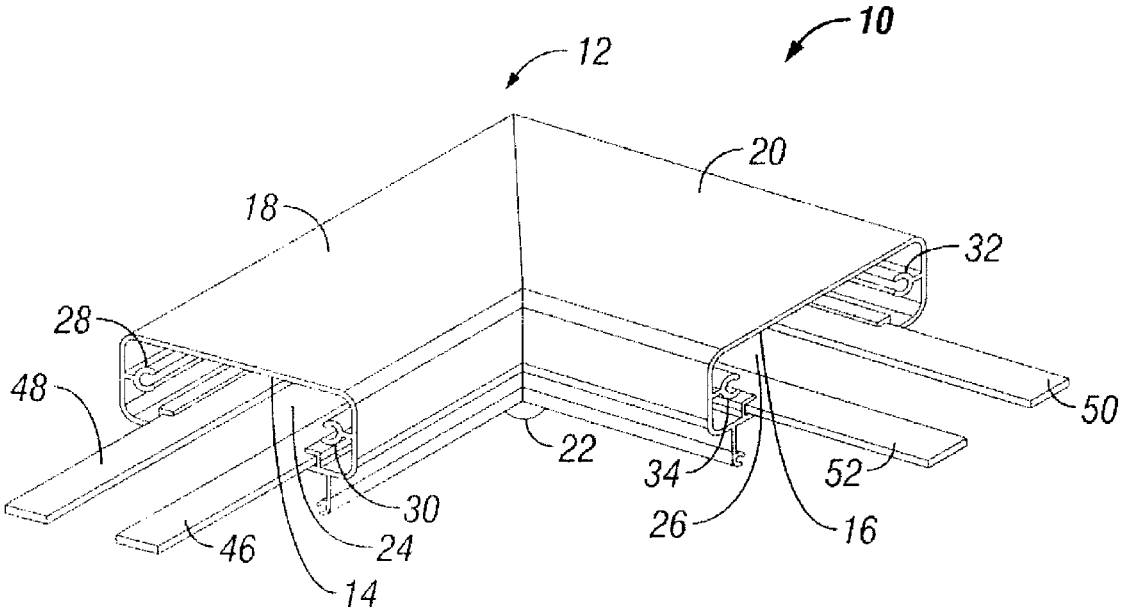
FIGS. 1A-C are perspective views of an embodiment of a corner assembly in accordance with the present invention.

In the following paragraphs, embodiments of the present invention will be described in detail by way of example with reference to the accompanying drawings. Throughout this description, the embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Referring to FIGS. 1A-G, an embodiment of a corner assembly is shown. Corner assembly 10 comprises an angled corner fitting 12 having a first end 14 and a second end 16. First cap rail component 18 and second cap rail component 20 are weld connected or joined by adhesive bonding to form a corner fitting 12 having angle 22. The angle shown is 90°, but other angles can be formed depending on the desired configuration of the railing system. Corner fitting 12 may have a powder coating or may be coated with anodic film to provide a smooth finish and the desired color.

The cap rail components shown in FIGS. 1A-G have a generally rectangular configuration. However, cap rail components could have different shapes such as round, oval, square or others depending on the desired appearance and function of the railing system. The shape and dimensions of the individual cap rail components should be the same so that when the two components are welded together, the edges are flush and there are no exposed edge portions. The cap rail components are preferably made of aluminum, and are preferably manufactured by extrusion. However, those of skill in the art would readily recognize that the cap rail components could be made of other materials such as steel, brass or plastic composite materials and by different manufacturing methods.

First cap rail component 18 has a channel 24, and second cap rail component 20 has a channel 26. When the cap rail components are welded or bonded together, the resulting corner fitting 12 has a first end and a second end and cap rail component channels 24 and 26 form an angled channel within the corner fitting. Each channel has at least one receiver within it. Channel 24 preferably has two receivers 28, 30 on opposite sides of the channel, and channel 26 also may have two receivers 32, 34 on opposite sides. The receivers may extend from the first end to the second end of the channels where cap rail component 18 is connected to cap rail component 20 such that receivers 28 and 32 and receivers 30 and 34 are connected to form continuous receivers extending from the first end of the corner fitting to the second end of the corner fitting. The receivers need not extend from end to end, and in an alternative configuration, the receivers may extend only part way into the cap rail component channels. Other receiver configurations may be employed depending on the application.

Figure 1B:
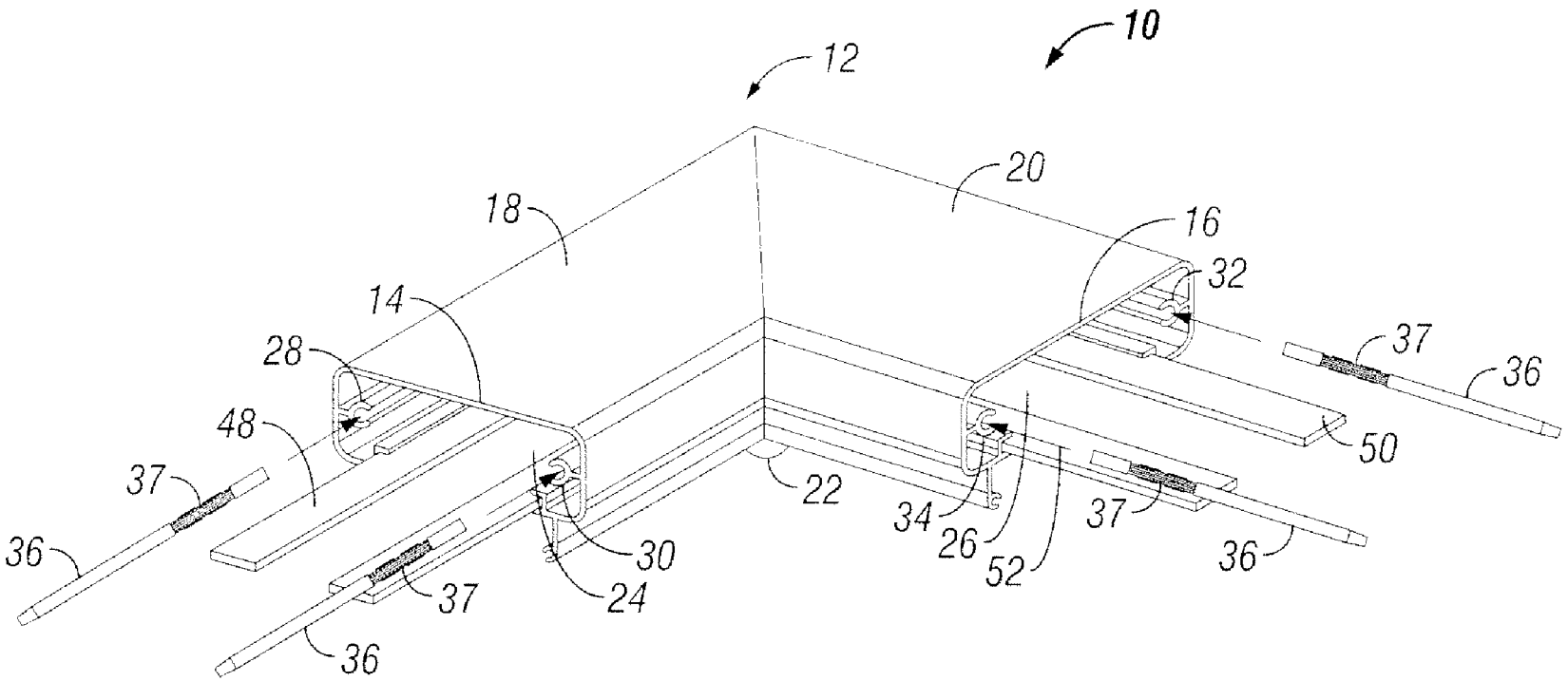
Figure 1C:
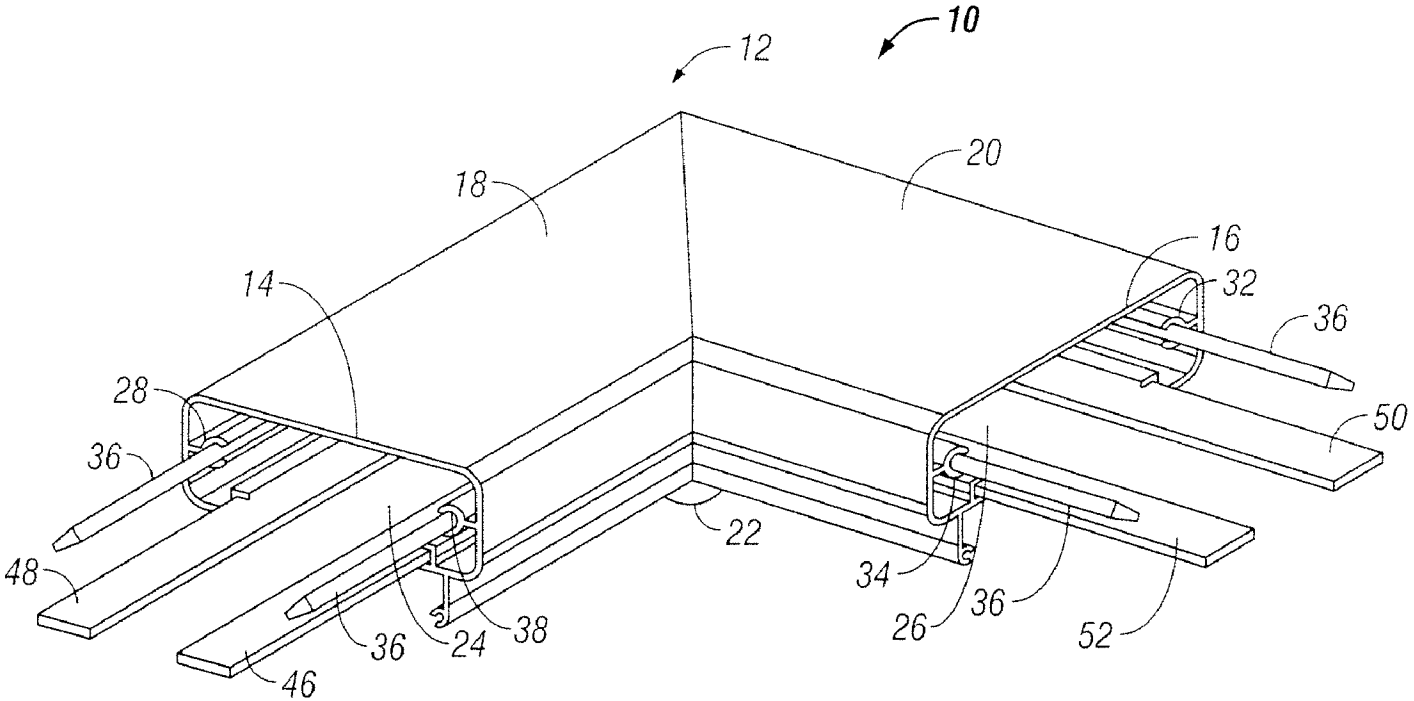

Each receiver contains at least one pin 36 disposed within a portion of the receiver. In a preferred embodiment, the receivers are substantially circular in shape to accommodate cylindrical pins 36, but other shapes may be used depending on the application. As best seen in FIG. 1C, pins 36 are pressed into receivers 28 and 30 within the first cap rail component channel 24 at one end of the corner fitting and extend past the receiver edge and out beyond end 14. Similarly, pins 36 are pressed into receivers 32 and 34 within the second cap rail component channel 26 at the other end of the corner fitting and extend beyond end 16. In some embodiments, the pins are placed in the receivers such that about half of each pin is disposed within the receiver and the other half of the pin extends out beyond the ends of the corner fittings. The pins preferably are made of stainless steel, which provides high shear strength to enhance the strength of the corner assembly. As can be seen in FIG. 1B, a portion of the pin may be knurled. Knurled portion 37 of pin 36 has a larger diameter than the rest of the pin. The knurled portion 37 allows the pin to lock into the receivers of the corner assembly. As will be described in detail herein, the pins serve to align the corner assembly with straight cap rail portions of a railing system and to aid in installation of the railing system.

Figure 1D:
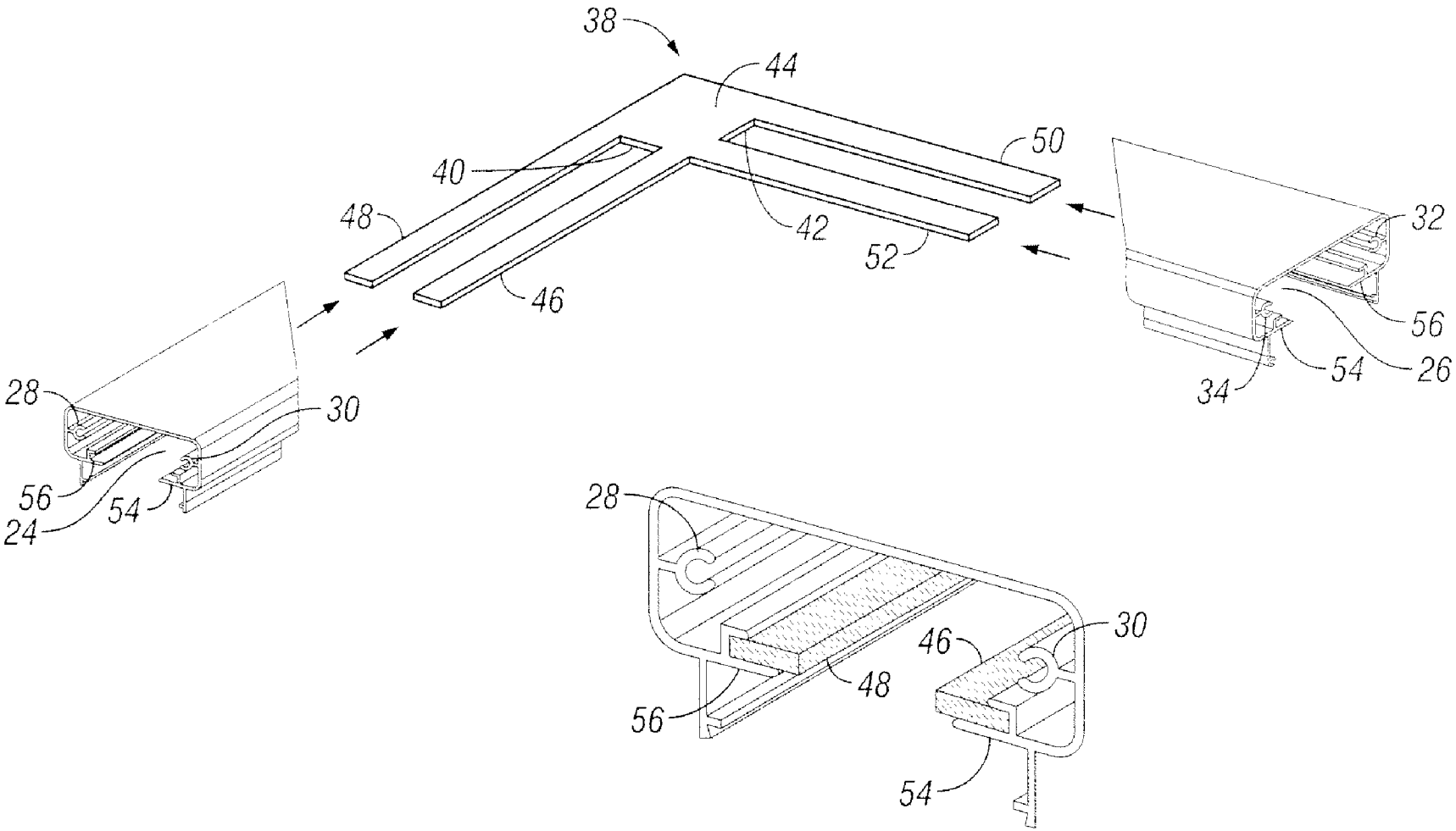
FIG. 1D is an exploded view of the corner assembly of FIGS. 1A-C showing a bracket.
Figure 1G:
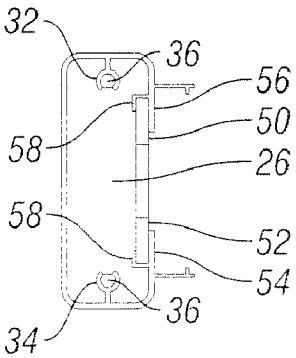
FIGS. 1E-G are plan views of the corner assembly of FIGS. 1-D.
Figure 1E:
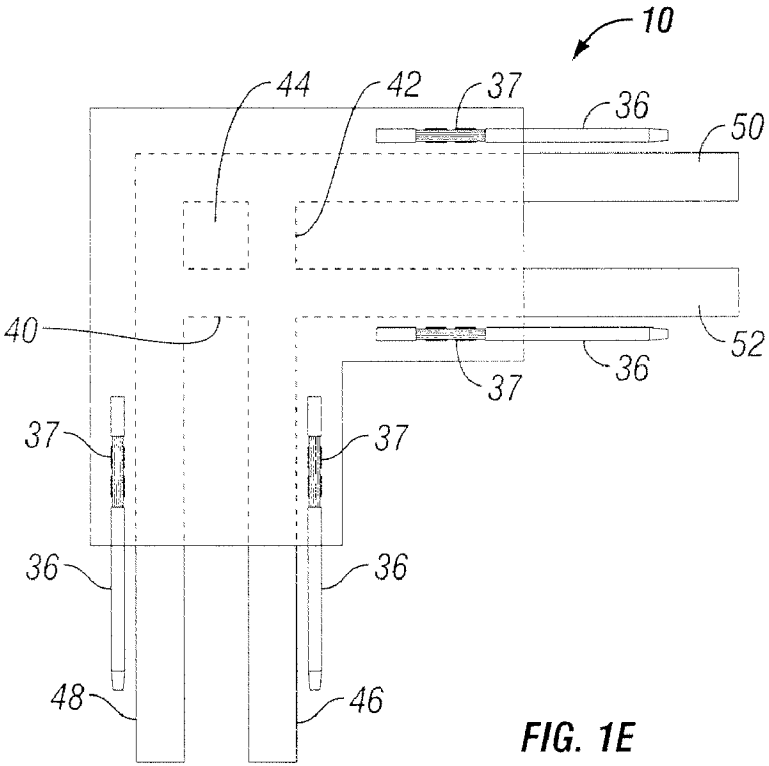
Figure 1F:
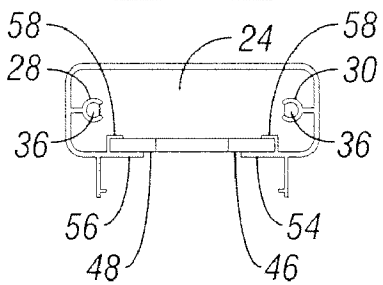

As can best be seen in FIG. 1D, the corner assembly further comprises bracket 38 having center portion 44 and first and second ends 40 and 42. In a preferred embodiment, two spaced-apart extensions 46, 48 extend from the first end of center portion 44 in one direction, and two spaced apart extensions 50, 52 extend in another direction from the second end of the center portion. The angled channel comprises first retainer 54 on one side and second retainer 56 on the other side. Both the center portion 44 and the extensions 46, 48, 50, 52 of bracket 38 fit into retainers 54 and 56 so the bracket is disposed within the corner fitting and attached to the interior channels.

Figures 2A, 2B, 2C:
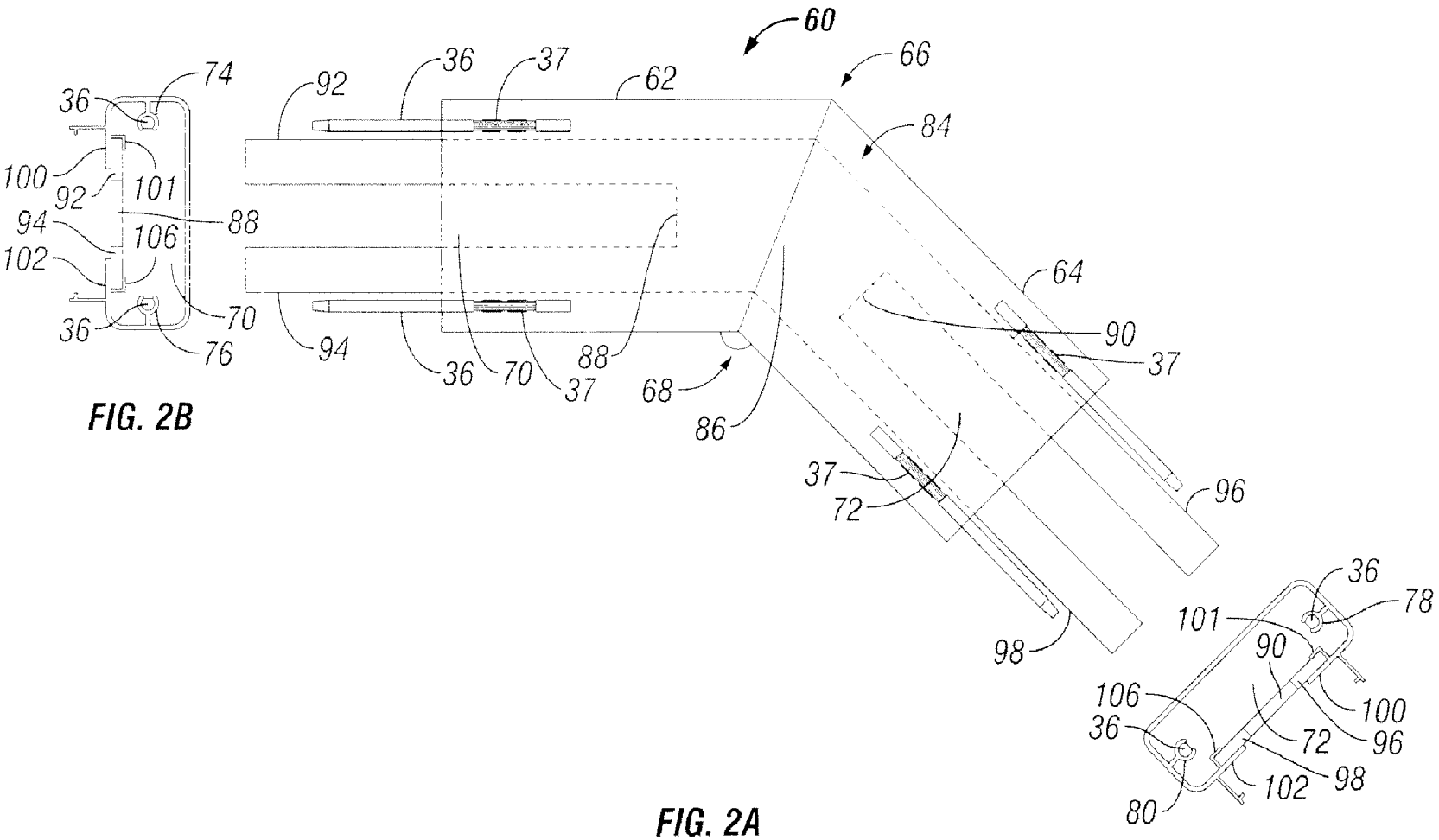
FIGS. 2A-C are plan views of an embodiment of a corner assembly in accordance with the present invention.

Referring to FIGS. 2A-C, an alternative embodiment of the invention is shown. Corner assembly 60 comprises two cap rail components 62 and 64 welded or bonded together to form a corner fitting 66 having an obtuse angle 68. Angle 68 is 135°, but other angles may be formed depending on the application. The cap rail components have channels 70 and 72. Each channel preferably has two receivers, 74 and 76, in channel 70 and receivers 78, 80 in channel 72. Each receiver contains at least one pin 36 disposed within a portion of the receiver such that about half of each pin is within the receiver and the other half of the pin extends past the receiver edge and out beyond the ends of the corner fitting. Corner assembly 60 further comprises bracket 84 having center portion 86, first end 88 and second end 90. The bracket preferably comprises two spaced apart extensions 92 and 94, which extend from the first end of center portion 86 in one direction, and two spaced apart extensions 96 and 98, which extend from the second end of center portion 86 in the other direction. Extensions 92, 94, 96 and 98 extend along the sides of channels 70 and 72 and fit into retainers 100 and 102 of the cap rail components.

Turning to FIGS. 3A-C, another embodiment has an alternative configuration of the channel interior components and a substantially oval shape. Corner assembly 110 comprises two cap rail components 112 and 114 welded together to form corner fitting 116 having angle 118. The angle shown here is 90 degrees, but the cap rail components can be welded together to form other angles. As can best be seen in the cross-sectional views of FIGS. 3B and 3C, cap rail component 112 has a channel 120, and cap rail component 114 has channel 134. There are receivers 122, 132 on each side of the channel configured to hold pins 36, as described above. The receivers shown are substantially circular, but may be other shapes to accommodate various types of pins or other alignment members. Retainers 124 and 126 extend inward from intermediate points on the sides of the channels along either side of the interior of cap rail component 112. Bracket 125 comprises center portion 127 and preferably extensions 128 and 130 extending in one direction through channel 134 and beyond the edge of the corner fitting. Bracket 125 may also comprise extensions 129 and 131 extending through channel 120 and beyond the other edge of the corner fitting. Extension 128 is disposed between retainer 124 and receiver 122, and bracket extension 130 is disposed between retainer 126 and receiver 132. In this embodiment, receivers 122 and 132 perform the dual functions of housing the pins and assisting in holding the bracket extensions.

Figure 4A:
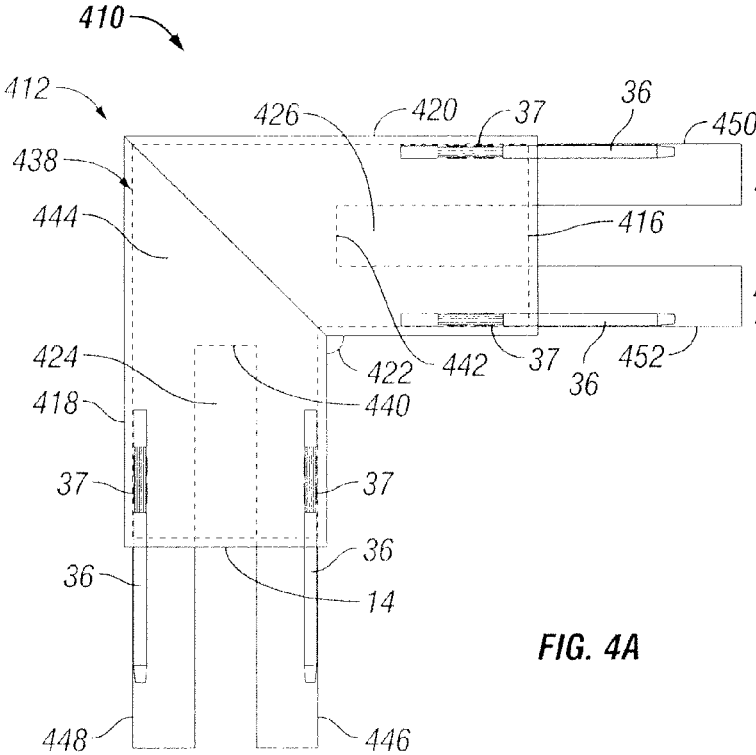
FIGS. 4A-C are plan views of an embodiment of a corner assembly in accordance with the present invention.
Figure 4B:
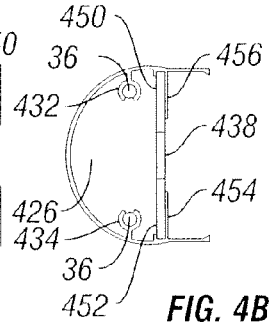
Figure 4C:
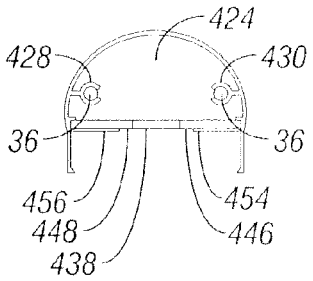
Figures 5A, 5B, 5C:
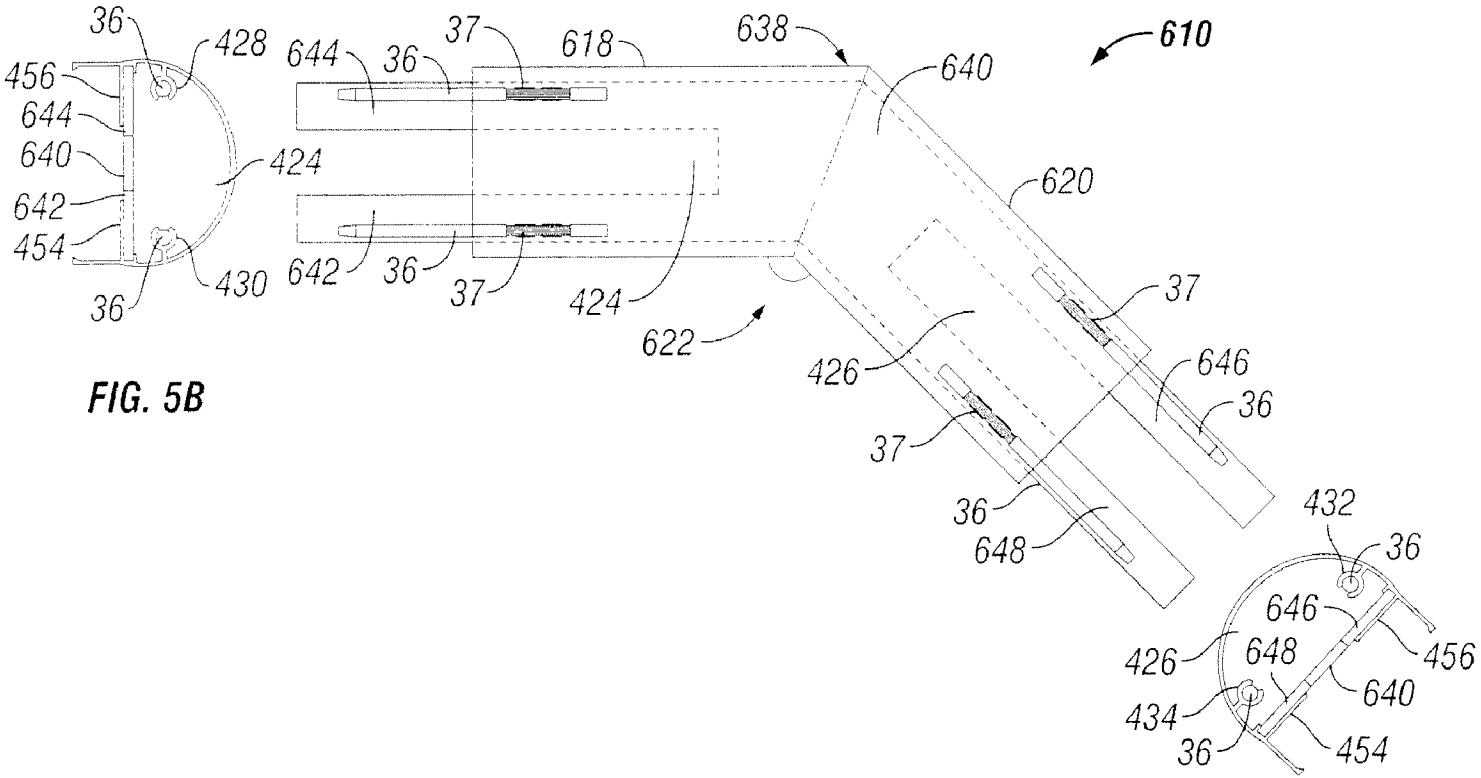
FIGS. 5A-C are plan views of an embodiment of a corner assembly in accordance with the present invention.
Figures 6A, 6B, 6C:
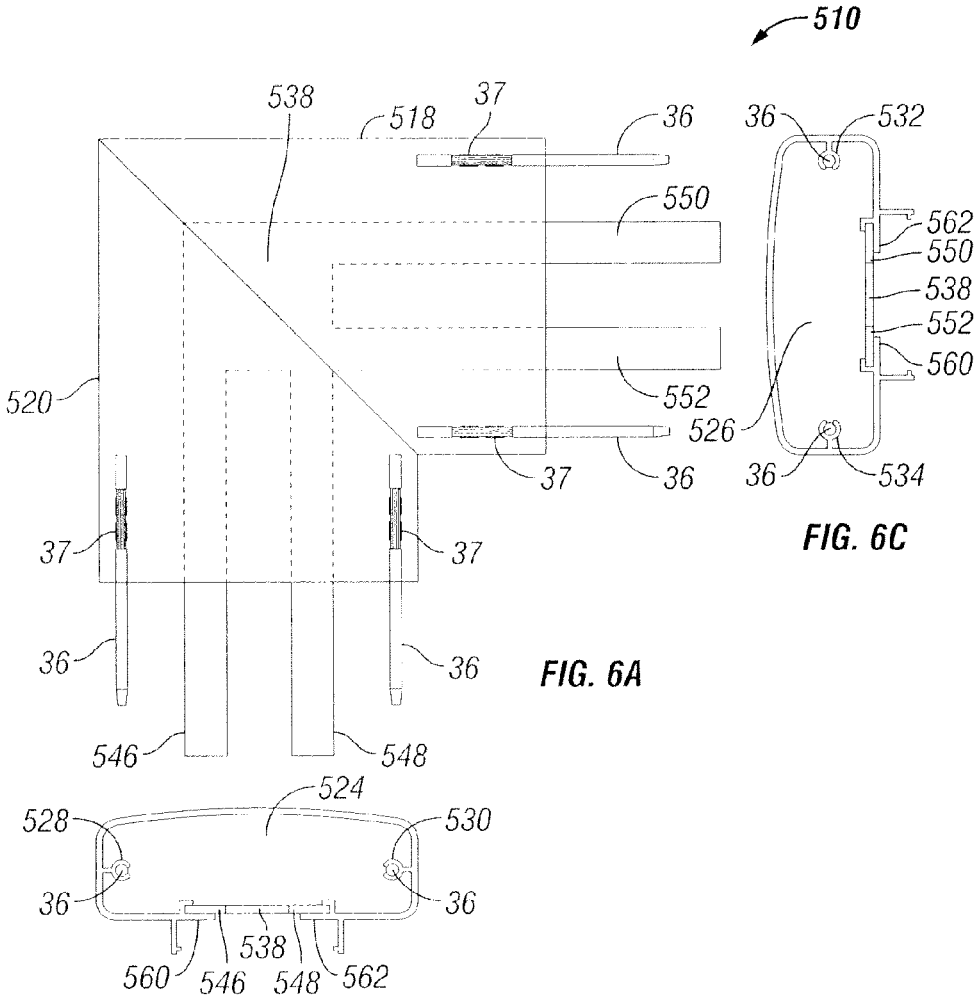
FIGS. 6A-C are plan views of an embodiment of a corner assembly in accordance with the present invention.

FIGS. 4A-C show an embodiment of the corner assembly of the present invention having a generally circular or tubular shape. Corner assembly 410 comprises channels 424 and 426, which may be somewhat larger than the channels in other embodiments due to their tubular configuration. Cap rail components 418 and 420 are welded together or joined by adhesive bonding to form angular corner fitting 412. The interior components and structure are otherwise similar to that of other embodiments. Channels 424 and 426 contain receivers 428, 430, 432 and 434. Pins 436 are disposed within the receivers and extend beyond the edges of the corner fitting. Bracket 438 has extensions 446, 448, 450, 452 and fits into retainers 454 and 456, which extend inward from the sides of the channels along either side of the interior of the cap rail components. FIGS. 5A-C show circular or tube-shaped cap rail components in an obtuse angle configuration. Cap rail components 618 and 620 are pre-fabricated and welded together or joined by adhesive bonding such that they form 135° angle 622. Bracket 638 also is configured to have a 135° angle so it fits within corner assembly 610. Bracket 638 comprises center portion 640 and two extensions 642, 644 extending through channel 424 and two spaced apart extensions 646, 648 extending through channel 426.

An embodiment shown in FIGS. 6A-D has a substantially rectangular shape and a convex top surface. Corner assembly 510 has cap rail components 518 and 520 and channels 524 and 526. As in other embodiments, the cap rail components are welded together or joined by adhesive bonding to form an angular corner fitting. The channels have receivers 528, 530, 532 and 534 at about the mid-points of the sides of the channels. Pins 536 are disposed within the receivers and extend beyond the edges of the corner fitting so they can be used to join and align the corner fitting with straight cap rail components. Corner assembly 510 further comprises bracket 538 having extensions 546, 548, 550 and 552. The bracket and spaced apart extensions fit into retainers 560 and 562 of the cap rail components, and the extensions may project into a channel of a straight cap rail component.

Figure 7:
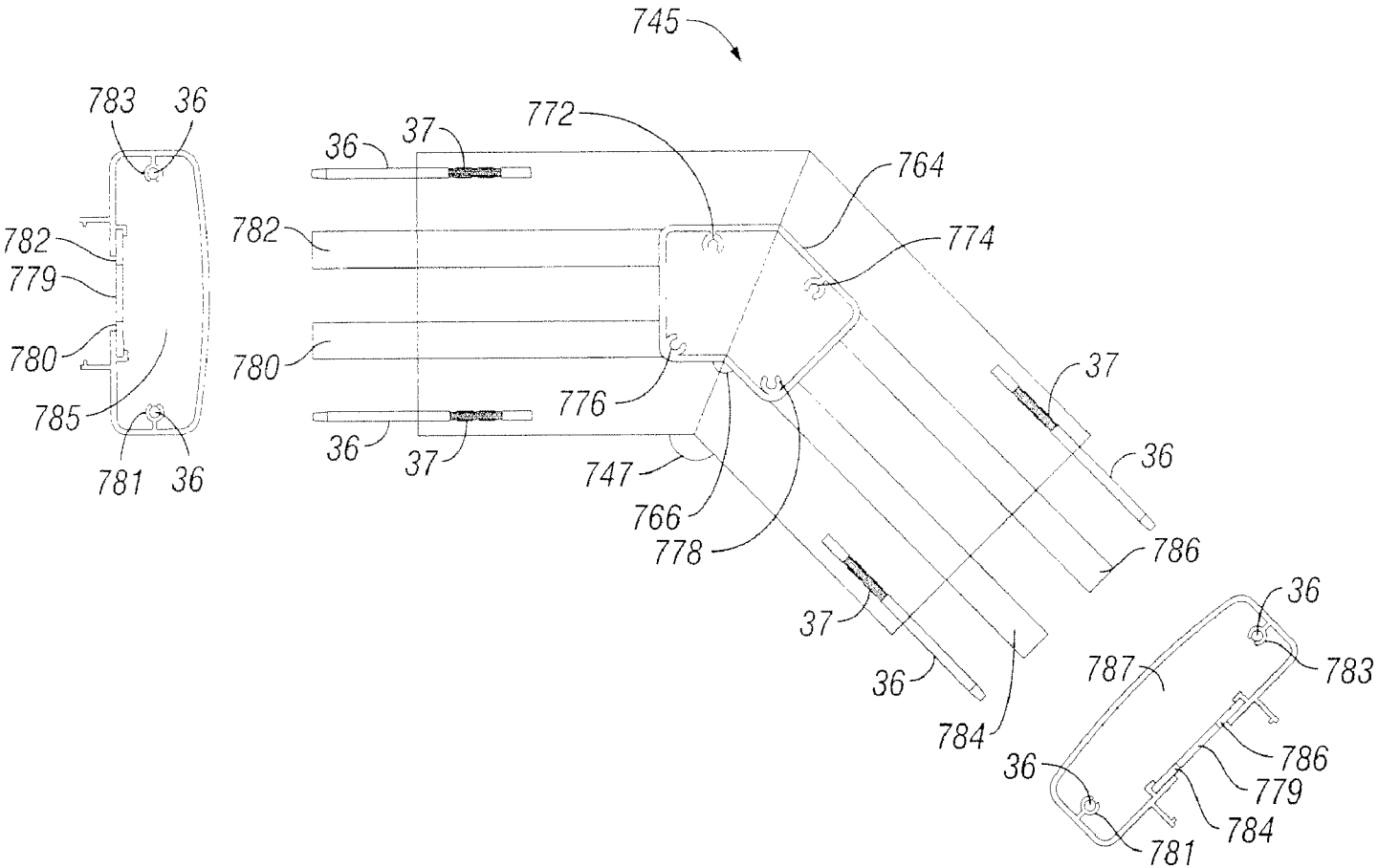
FIG. 7 is a plan view of an embodiment of a corner assembly in accordance with the present invention showing a post assembly.

Referring to FIG. 7, embodiments of the railing system of the present invention, which comprises a corner assembly and a post assembly, are shown. Post 764 is a vertical member with a sectional configuration of the same angle as that of the corner fitting. This is so the corner assembly may be aligned with post 764. Thus, angle 766 of post 764 is the same as angle 747 of corner assembly 745 so the edges of the post are flush against the bottom of the cap rail components. Post 764 has four internal receivers, which receive screws to fasten corner assembly 745 to post 764 Receivers 772, 774 extend from the internal walls of the post, and 776 and 778 are in the corners of the post. Extensions 780, 782, 784 and 786 extend from the bracket 779. Receivers 781 and 783 within channels 785 and 787 receive alignment pins 36.

Figure 8:
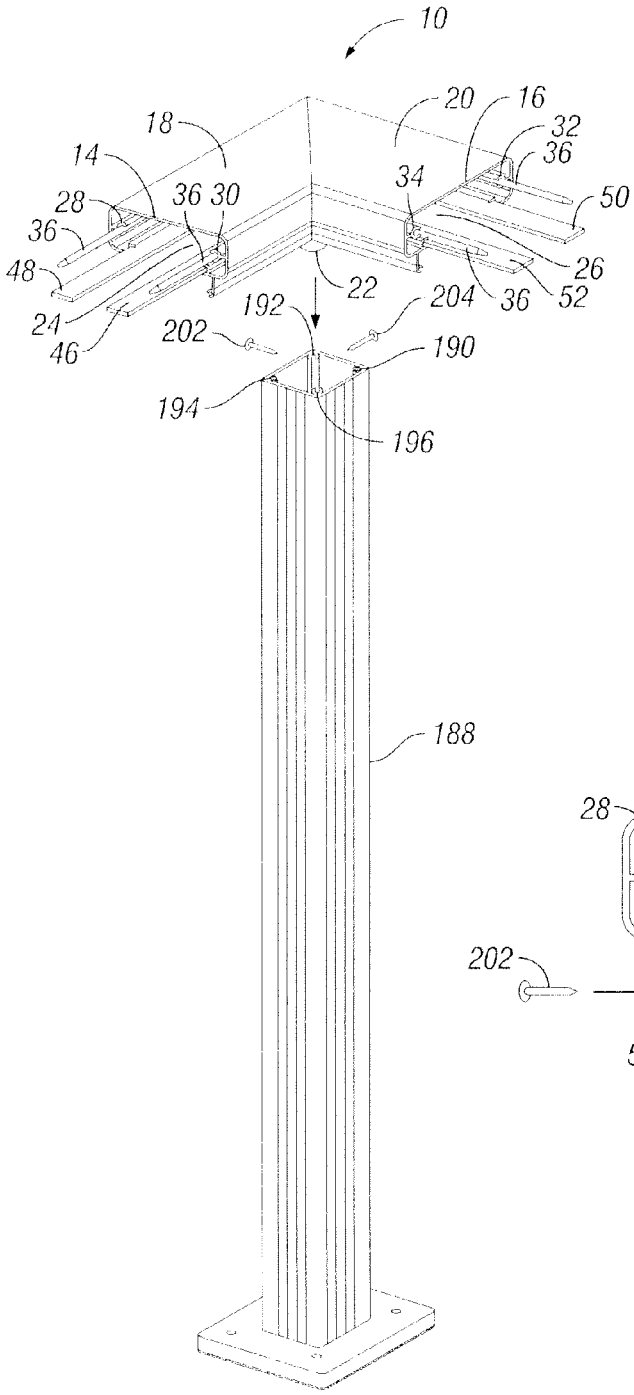
FIG. 8 is a perspective view of an embodiment of a corner assembly in accordance with the present invention showing a post assembly.
Figure 9:
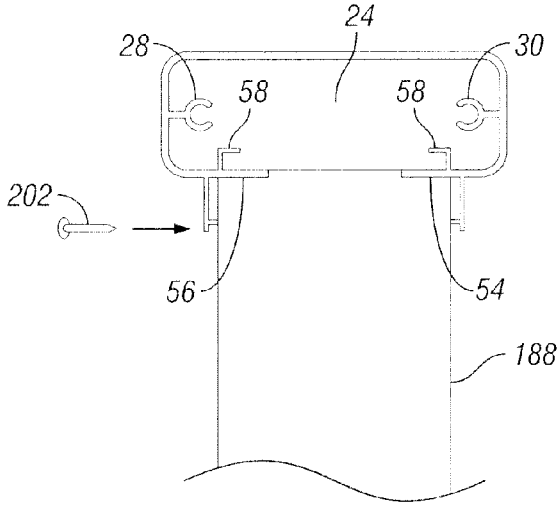
FIG. 9 is a plan view of an embodiment of a corner assembly in accordance with the present invention showing a post assembly.

FIGS. 8 and 9 show embodiments of the railing system of the present invention, which comprises a corner assembly attached to a post assembly and may comprise a straight rail assembly. Corner assembly 10 is composed of cap rail component 18 and cap rail component 20 welded or bonded together to form a corner fitting with angle 22. Post 188 is a vertical member with a square cross section. The interior of post 188 contains four substantially circular receivers 190, 192, 194 and 196, which can house screws or alignment pins which serve to attach the corner fitting to the post. Post 188 is attached to the corner fitting by lining up the top of the post with the bottom of the corner assembly at the angled portion where the two cap rail components meet. The corners of the post are pressed against retainers 54 and 56. Screw 202 penetrates the top of one side of post 188, thereby fastening the post to the corner fitting at the bottom of cap rail component 18, and screw 204 penetrates the top of an adjacent side of post 188 to fasten the post to the corner fitting at the bottom of cap rail component 20.

Figure 10:
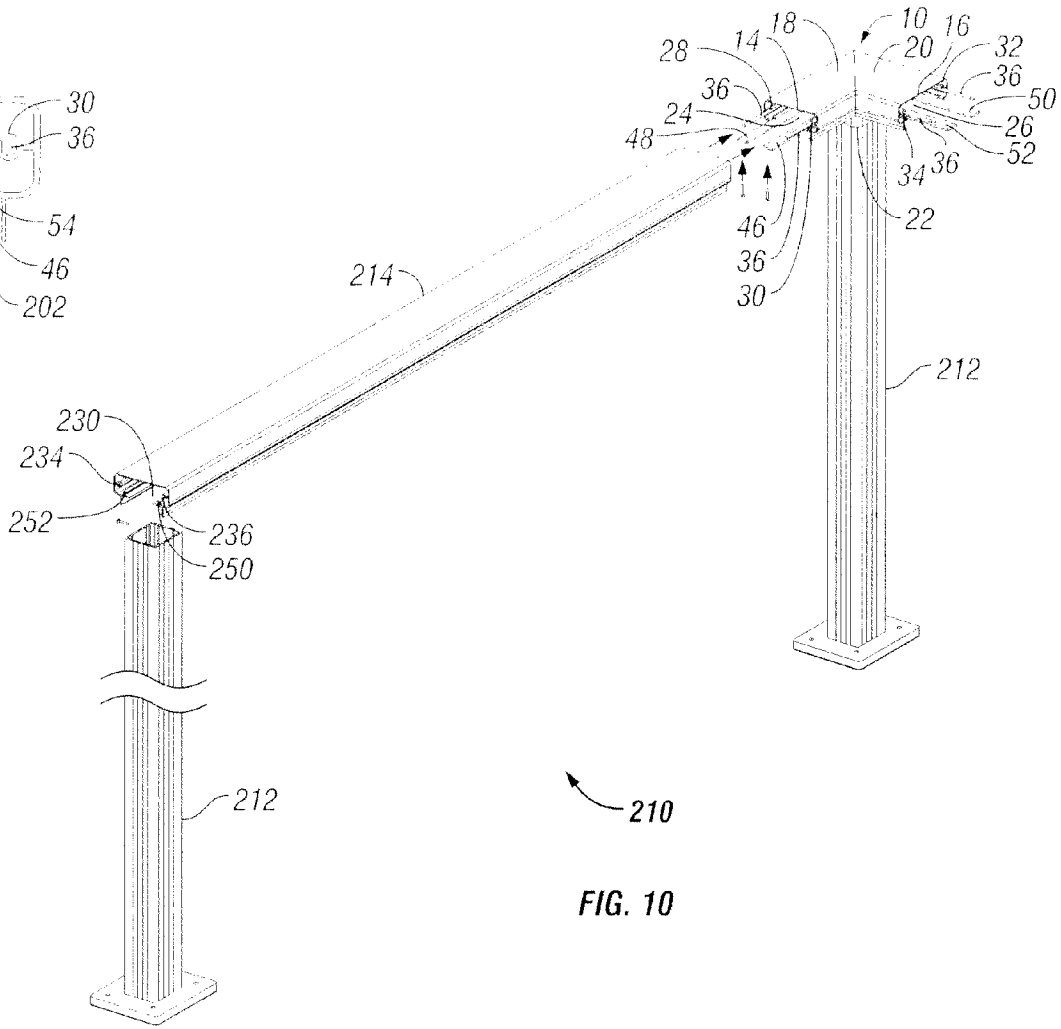
FIG. 10 is a perspective view of an embodiment of a component railing system in accordance with the present invention.
Figure 11:
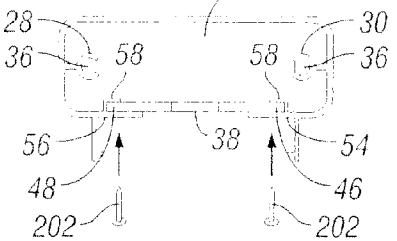
FIG. 11 is a plan view of an embodiment of a corner assembly in accordance with the present invention.
Figure 12:
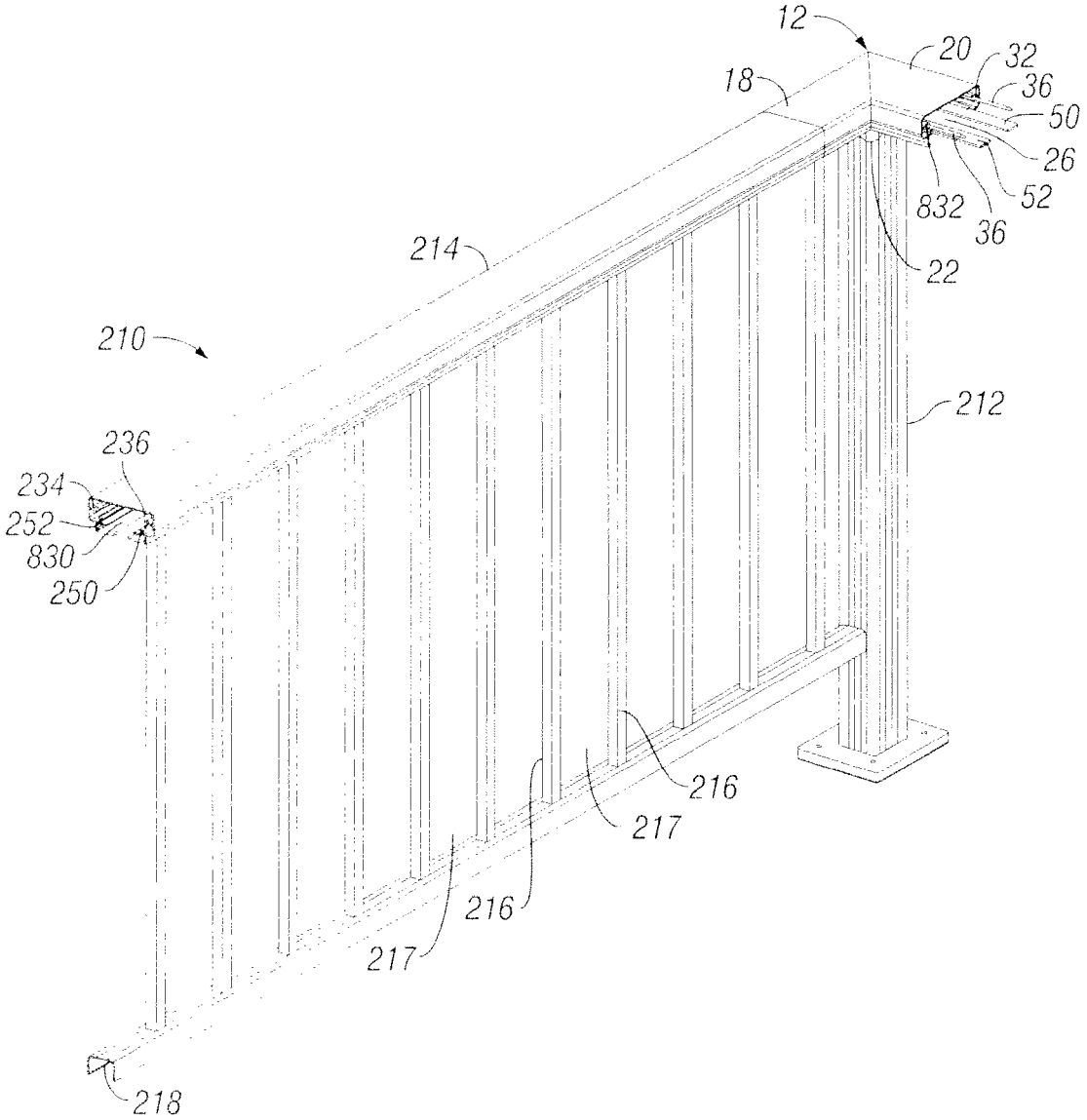
FIG. 12 is a perspective view of an embodiment of a component railing system in accordance with the present invention.
Figure 13:
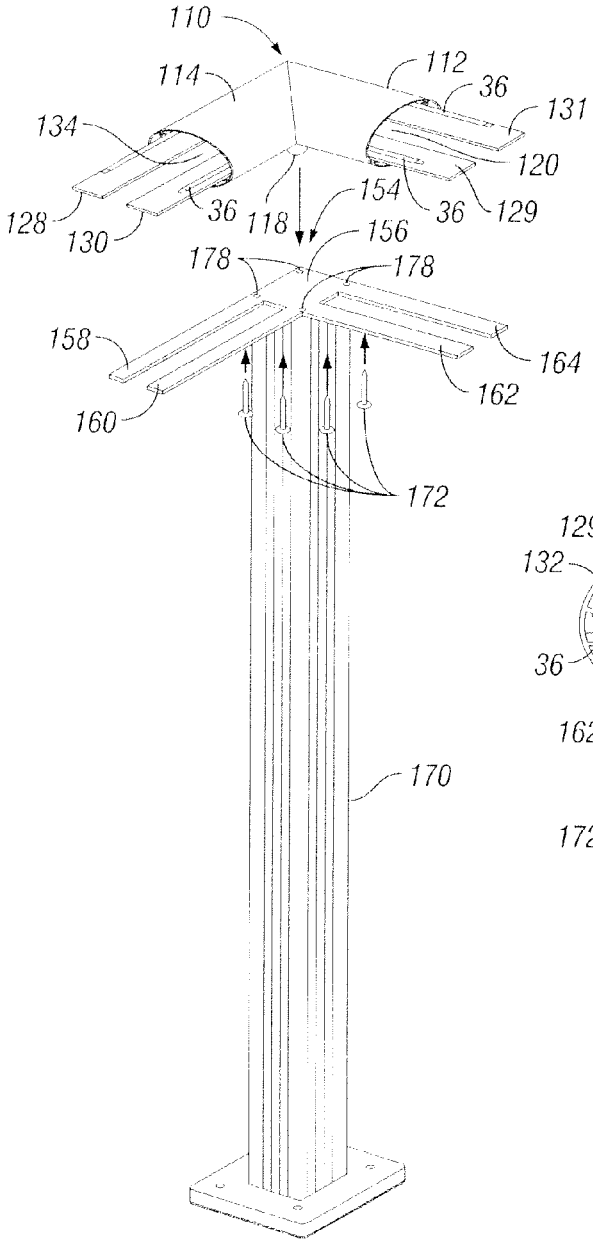
FIG. 13 is a perspective view of a corner assembly in accordance with the present invention showing a post mounted bracket and a post assembly.
Figure 14:
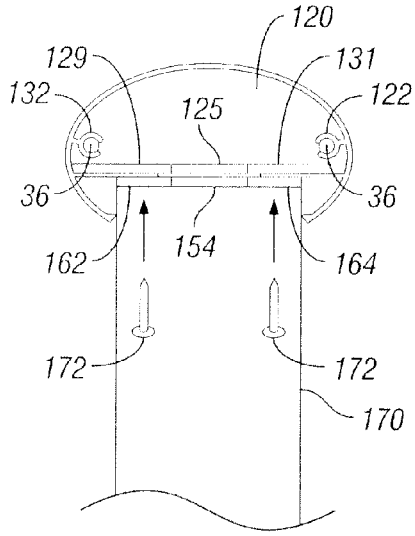
FIG. 14 is a plan view of a corner assembly in accordance with the present invention showing a post mounted bracket and a post assembly.
Figure 15:
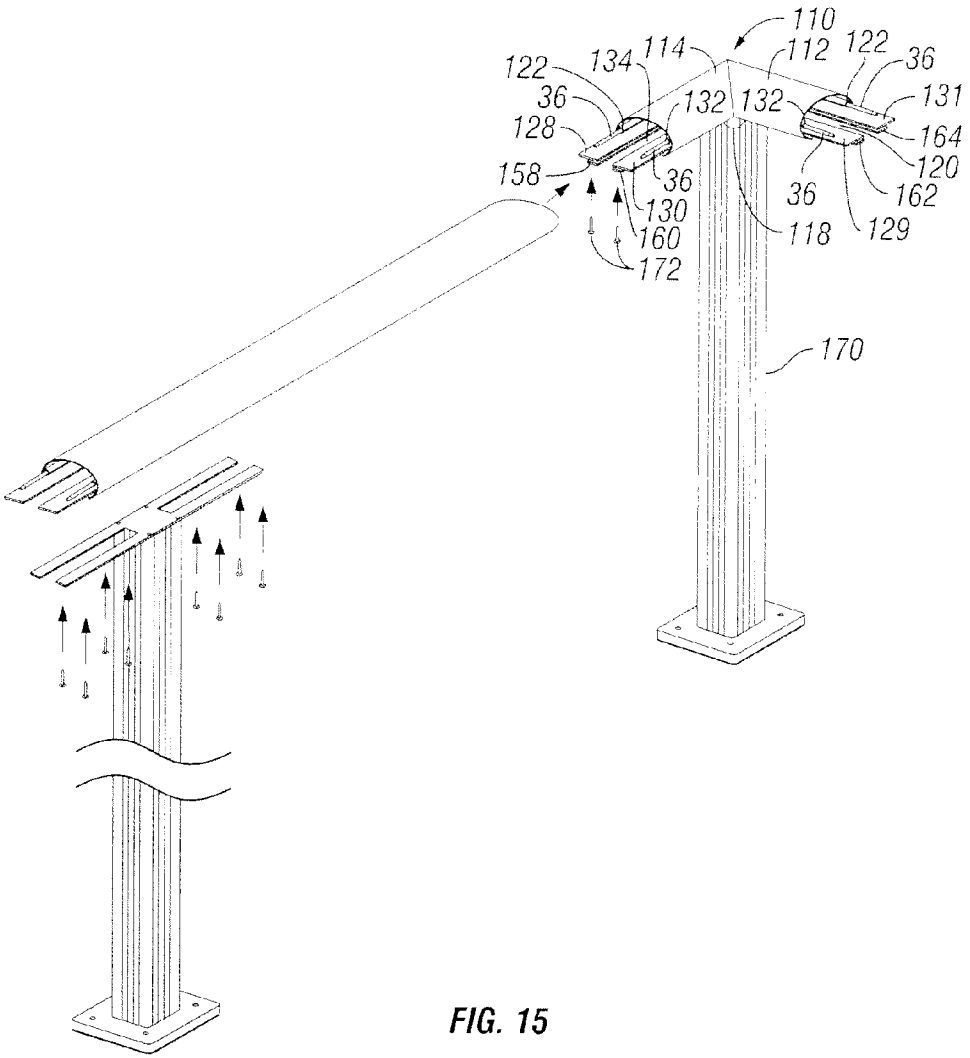
FIG. 15 is a perspective view of a corner assembly in accordance with the present invention showing a post mounted bracket and a post assembly.
Figure 16:
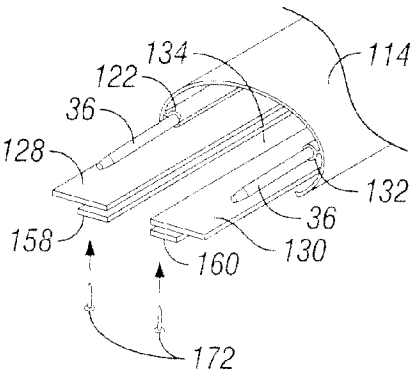
FIG. 16 is a perspective view of a corner assembly in accordance with the present invention showing a post mounted bracket.

Turning to FIGS. 10-12, a component railing system 210 employing the welded corner assembly of FIGS. 1A-G will be described. The system includes at least one post 212, straight cap rail 214 and angled corner fitting 12. Angled corner fitting 12 is composed of a first cap rail component 18 having a channel 24 and receivers 28 and 30 and second cap rail component 20 having a channel 26 and receivers 32 and 34. As described in detail above, the cap rail components are weld connected or attached by adhesive bonding to form a corner fitting having an angle. The post preferably is fixed at its base, such as by cement or by mechanical means. Component railing system 210 also may include pickets 216, glass panels 217, and a base shoe 218. The corner fitting 12 is disposed at the end of a straight cap rail and may include a second straight cap rail (not shown). The corner assembly may be attached to a cap rail at a location where the railed-in area requires the railing to change direction, such as the corner of a balcony. Each cap rail 214 defines a cap rail channel 230 that preferably extends the entire length of the cap rail 214. Corner fitting channel 24 is aligned with straight cap rail channels 230 using pins 36.

Cap rail channel 230 has receivers 234 and 236 on each side of the channel. Receivers 28 and 30 are located substantially toward the end of the cap rail, but may extend along the entire length of the cap rail. Receivers 238 and 240 are of the same size and shape as cap rail receivers 28 and 30 such that the corner fitting receivers and the cap rail receivers meet and form continuous receivers for pins 36 to align the corner assembly with the straight cap rail portion of the railing system. This receiver and pin structure also facilitates installation of the component railing system. To assemble the component railing system, the railing installer lines up the cap rails with the corner fittings in the desired configuration and inserts one pin 36 into receivers 28 and 30 and the other pin 36 into receivers 236 and 240.

Bracket 838 is disposed within the channels of the corner fitting as described in detail above. As shown in FIGS. 10 and 12, two extensions 46, 48 of bracket 38 extend beyond the first end of corner assembly 10 into cap rail 214. The corner assembly includes retainers 54 and 56 in the cap rail components, and each straight cap rail includes retainers 250 and 252, which correspond in size and shape to the corner assembly retainers. When assembling the component railing system, the railing installer lines up the cap rails with the corner fittings in the desired configuration and inserts extensions 46 and 48 into retainers 250 and 252. In this way, the bracket extensions facilitate assembly of the component railing system and provide additional support and alignment for the system.

In some embodiments of the present invention, the corner assembly comprises a post mounted bracket, which primarily serves to hold the components of the corner assembly together. This post mounted bracket may be used in conjunction with the embodiment of the corner assembly shown in FIGS. 3A-C. As can be seen in FIGS. 3A-C, retainers 124 and 126 extend inward from intermediate points in the channel rather than being located at the bottom of the corner fitting, and therefore they do not provide advantageous surfaces for screws to hold the corner assembly together.

Accordingly, as seen in FIGS. 13-16, post mounted bracket 154 is provided. The two cap rail components 112 and 114 of corner fitting 110 have channels 120 and 134. Post mounted bracket 154 preferably has a size and shape similar to that of bracket 125 and bracket extensions 128, 130, 129 and 131 so it can fit closely beneath the bracket and substantially align therewith. Thus, post mounted bracket 154 comprises a center portion 156 and two spaced apart extensions 158, 160 extending from one end and two spaced apart extensions 162, 164 extending from another end of the post mounted bracket. Post mounted bracket 154 is screwed onto post 170 by self-tapping screws 178 that penetrate center portion 156, preferably at the corners of the center portion. Post mounted bracket 154 is connected to bracket 125 and thereby fastened to the corner assembly 110 by using screws 172 to penetrate post mounted bracket extensions 158, 160, 162 and 164 and bracket extensions 128, 130, 129 and 131. Thus, corner assembly 110 is placed on top of post mounted bracket 154 such that bracket 125 is directly above and aligned with post mounted bracket 154, including alignment of post mounted bracket extensions 158, 160, 162 and 164 and bracket extensions 128, 130, 129 and 131. Toward one end of the corner assembly, screws 172 fasten bracket extensions 128 and 130 to post mounted bracket extensions 158 and 160, respectively. Toward the other end of the corner assembly, screws 172 fasten bracket extensions 129 and 131 to post mounted bracket extensions 162 and 164, respectively. Screws 172 secure the bracket 138 to the post mounted bracket 154 and prevent the corner assembly from coming apart longitudinally. The screws are preferably self-drilling stainless steel screws.

A method of manufacturing a corner assembly for a component railing system will now be described. At least two cap rail components are formed, preferably of aluminum, but may be composed of other materials known to those of skill in the art. The cap rail components are manufactured preferably by extrusion to form a first end, a second end and to define channels therein. At least one receiver is formed within the channel of each cap rail component preferably by extrusion such that the receiver extends from the first end to the second end of each cap rail component. The receivers preferably are composed of aluminum, but may be made of other materials, and preferably would be made of the same material as the cap rail components. In a preferred embodiment, two receivers are formed and the receivers are manufactured to have a substantially circular shape.

The two cap rail components are then welded together using welding techniques known in the art or joined by adhesive bonding to form an angled corner fitting having a first end and a second end. The first cap rail component channel and the second cap rail component channel form an angled channel within the corner fitting. In a preferred manufacturing method, the corner fitting may have a powder coating or may be coated with anodic film by using coating methods known in the art to provide a smooth, attractive finish and cover the welded edges of the two cap rail components. A pin is pressed into the end of each extruded receiver at each end of the corner fitting such that the pin is disposed within at least a portion of the receiver and extends beyond the edge of the receiver and beyond the end of the corner fitting.

The bracket preferably is made of 6036/T6 aluminum by laser-cutting techniques known in the art. However, the bracket may be made from other varieties of aluminum or other suitable materials. The bracket is made with a center portion, said center portion having a first end and a second end and preferably two spaced-apart extensions extending from the first end of the center portion and two spaced apart extensions extending from the second end of the center portion. The bracket is inserted within the channels of the corner fitting. Retainers are made by extrusion and formed on each side of the channel such that they extend along the sides of the channel over the full length of the corner fitting. The bracket is inserted such that both the center portion and the extensions are fitted into the retainers.

The post mounted bracket preferably is made of 6063/T6 aluminum by laser-cutting techniques known in the art. However, the post mounted bracket may be made from other varieties of aluminum or other suitable materials. It generally is formed to have a center portion and two spaced apart extensions extending from each end. The structure of the post mounted bracket is made to be similar to the corner fitting bracket so that it can easily align with and attach to the bottom of the bracket. At least one screw hole is formed in each of the extensions so the post mounted bracket can be screwed onto the extensions and thereby fastened to the corner fitting. The post mounted bracket is fastened to the corner fitting by inserting screws through screw holes such that they penetrate the retainers and the bracket. Preferably self-drilling stainless steel screws are used to fasten the post mounted bracket extensions to the bracket extensions.

Thus, it is seen that a pre-fabricated welded corner fitting and method of manufacture are provided. It should be understood that any of the foregoing configurations and specialized components may be interchangeably used with any of the systems of the preceding embodiments. Although preferred illustrative embodiments of the present invention are described hereinabove, it will be evident to one skilled in the art that various changes and modifications may be made therein without departing from the invention. It is intended in the appended claims to cover all such changes and modifications that fall within the true spirit and scope of the invention.

What is claimed is:

1. A corner assembly comprising:

a unitary corner fitting including a first cap rail portion having first and second side walls and a second cap rail portion in non-linear relation to the first cap rail portion, the second cap rail portion having third and fourth side walls, the third side wall being fixedly attached to the first side wall and the fourth side wall being fixedly attached to the second side wall such that the side walls define an enclosed angled channel, each side wall including at least one longitudinally extending retainer extending inward therefrom;

at least one elongate receiver each linearly mounted on a respective one of the first or second side walls within the first cap rail portion and at least one elongate receiver each linearly mounted on a respective one of the third or fourth side walls within the second cap rail portion;

an elongate pin disposed within the at least one elongate receiver in the first cap rail portion and, the elongate pin having a portion locking the elongate pin in the elongate receiver, a second elongate pin disposed within the at least one elongate receiver in the second cap rail portion, the elongate pin having a portion locking the elongate pin in the elongate receiver, each elongate pin displaced from and parallel to the respective cap rail portion and a portion of each elongate pin extending outside the enclosed angled channel for being received within an elongate receiver of a respective cap rail;

an L-shaped bracket having a center portion centrally disposed within the enclosed angled channel, a first leg extending from the center portion in a first direction within the first cap rail portion and a second leg extending from the center portion in a second direction within the second cap rail portion, the bracket being disposed within the enclosed angled channel such that each of the legs rests on the at least one retainer within a respective one of the first and second cap rail portions; and a post connector bracket having a center portion for being fixed ontop a post, a first leg extending from the center portion of the post connector bracket in a first direction and a second leg extending from the center portion of the post connector bracket in a second direction, the center portion of the post connector bracket being releasably fastened to the center portion of the L-shaped bracket and the legs of the post connector bracket being substantially aligned with the legs of the L-shaped bracket.

2. The corner assembly of claim 1 wherein the at least one elongate receiver within the first cap rail portion comprises a first elongate receiver mounted on the first side wall and a second elongate receiver mounted on the second side wall.

3. The corner assembly of claim 2 wherein the at least one elongate receiver within the second cap rail portion comprises a third elongate receiver mounted on the third side wall and a fourth elongate receiver mounted on the fourth side wall.

4. The corner assembly of claim 1 wherein the first leg of the L-shaped bracket comprises two spaced apart legs.

5. The corner assembly of claim 4 wherein the second leg of the L-shaped bracket comprises two spaced apart legs.

6. The corner assembly of claim 5 wherein the two spaced apart legs of the first and second legs of the L-shaped bracket extend outside the enclosed angled channel.

7. The corner assembly of claim 5 wherein the two spaced apart legs are substantially longer than the center portion of the L-shaped bracket.

8. The corner assembly of claim 4 wherein the two spaced apart legs are substantially longer than the center portion of the L-shaped bracket.

9. The corner assembly of claim 1 wherein the first leg of the post connector bracket comprises two spaced apart legs.

10. The corner assembly of claim 9 wherein the second leg of the post connector bracket comprises two spaced apart legs.

11. The corner assembly of claim 1 wherein the L-shaped bracket is located directly below the respective at least one elongate receiver.

12. The corner assembly of claim 1 wherein at least one of the first leg or the second leg of the L-shaped bracket extends outside the enclosed angled channel.

13. The corner assembly of claim 1 wherein the at least one retainer is fixedly attached to an intermediate point on each respective side wall.

14. The corner assembly of claim 1 wherein the first leg of the post connector bracket is directly below and in contact with the at least one retainer within a respective one of the first and second cap rail portions.

* * * * *